US007227309B2

(12) United States Patent
Horibe et al.

(10) Patent No.: US 7,227,309 B2
(45) Date of Patent: Jun. 5, 2007

(54) METAL HALIDE LAMP

(75) Inventors: Yasutaka Horibe, Nara (JP); Yoshiharu Nishiura, Shiga (JP); Shunsuke Kakisaka, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/392,577

(22) Filed: Mar. 20, 2003

(65) Prior Publication Data

US 2003/0178941 A1 Sep. 25, 2003

(30) Foreign Application Priority Data

Mar. 20, 2002 (JP) ..... 2002-078394
Mar. 18, 2003 (JP) ..... 2003-074450

(51) Int. Cl.
*H01J 17/16* (2006.01)

(52) U.S. Cl. ..... 313/634; 493/573; 493/609; 493/640; 493/641; 315/56

(58) Field of Classification Search ..... 313/634, 313/493, 574, 609, 573, 640, 641; 315/56, 315/82, 57

See application file for complete search history.

(56) References Cited

U.S. PATENT DOCUMENTS 4,925,074 A * 5/1990 Wood ..... 228/49.1
5,576,592 A * 11/1996 Koenigsberg et al. ..... 313/25
5,952,784 A 9/1999 Witting
6,075,314 A 6/2000 Huettinger et al.
6,583,563 B1 * 6/2003 Venkataramani et al. ... 313/634
6,661,176 B2 * 12/2003 Honda et al. ..... 315/56
7,034,461 B2 * 4/2006 Brock ..... 313/634
2002/0070667 A1 6/2002 Miyazawa
2003/0173901 A1 * 9/2003 Miura et al. ..... 313/634

FOREIGN PATENT DOCUMENTS

CN 1204138 1/1999
CN 1248785 3/2000
JP 8-301666 11/1996
JP 11-204086 7/1999

* cited by examiner

*Primary Examiner*—Karabi Guharay
*Assistant Examiner*—Anthony Canning
(74) *Attorney, Agent, or Firm*—Hamre, Schumann, Mueller & Larson, P.C.

(57) ABSTRACT

The present invention provides a metal halide lamp in which the change of the color temperature is suppressed regardless of the orientation of the light emitting bulb in use. The metal halide lamp includes a light emitting bulb of translucent ceramics that includes a light emitting portion and tubular portions that are connected to the light emitting portion. The light emitting portion includes a liquid holding portion on the inner surface of the light emitting portion so as to hold a liquefied substance that moves on the inner surface toward one of the tubular portions. The internal diameter d of the light emitting bulb at the liquid holding portion satisfies $0.4D<d<0.7D$, where D is an internal diameter of the light emitting bulb at the maximum internal diameter portion of the light emitting portion.

11 Claims, 10 Drawing Sheets

METAL HALIDE LAMP

FIELD OF THE INVENTION

The present invention relates to a metal halide lamp that includes a light emitting bulb of translucent ceramic.

BACKGROUND OF THE INVENTION

Translucent ceramics such as alumina are used for a light emitting bulb of a metal halide lamp. As shown in FIG. 10, a light emitting portion 31*a* and tubular portions 31*b* of the light emitting bulb are molded in one piece to increase heat efficiency and improve lamp characteristics.

A metal halide lamp that includes an integrally molded light emitting bulb is shown in FIG. 11 and a sectional view of this light emitting bulb is shown in FIG. 12.

The light emitting bulb 31 is placed in an outer bulb 32 and lead wires 33*a* and 33*b* are attached to the tubular portions of the light emitting bulb 31. The lead wires 33*a* and 33*b* are connected to electrodes 17*a* and 17*b* in the bulb 31. One end of the outer bulb 32 is closed by a base 34. A stem 36 holds stem leads 35*a* and 35*b*, and one of the stem leads 35*a* is connected to the lead wire 33*a* and the other stem lead 35*b* is connected to the lead wire 33*b* via a power supply wire 37.

Mercury and an iodide of cerium, sodium, thallium, indium, or scandium are sealed in the light emitting bulb 31. When turning on the lamp, the mercury is heated and vaporized by an electric discharge between the electrodes 17*a* and 17*b*. Then, the iodide is liquefied and a part of the iodide is vaporized. However, another part of the iodide is attached to the inner surface of the light emitting bulb 31 in a liquid state. When a longitudinal direction of the bulb 31 is arranged along a vertical direction as in FIG. 12 and the lamp is turned on, the liquid iodide is dropped into a gap between the inner surface of the lower tubular portion and the electrode 17*a*. The liquid iodide 38 in the tubular portion reduces a vapor pressure of iodide in the bulb and causes a change in lamp characteristics, especially in color temperature.

SUMMARY OF THE INVENTION

The object of the present invention is to provide a metal halide lamp in which the change in color temperature during its life is suppressed regardless of the orientation of the axis of light emitting bulb.

The present invention improves a metal halide lamp that includes a light emitting bulb of translucent ceramics in which tubular portions are connected to a pair of the ends of a light emitting portion. The metal halide lamp of the present invention includes a liquid holding portion on the inner surface of the light emitting portion so as to hold a liquefied substance that moves on the inner surface of the light emitting portion toward the tubular portion. The internal diameter d of the light emitting bulb at the liquid holding portion satisfies $0.4D<d<0.7D$, where D is an internal diameter of the light emitting bulb at the maximum internal diameter portion.

The liquid holding portion prevents a liquefied iodide from dropping into the tubular portion. However, when the liquid holding portion is arranged too close to the electrode of the lamp, the liquefied iodide is strongly heated. The liquefied iodide at a high temperature accelerates the corrosion of the translucent ceramics and may cause cracks in the light emitting bulb. On the other hand, if the liquid holding portion is arranged at a considerable distance from the tubular portion, the liquid holding portion cannot prevent the liquefied iodide from dropping effectively. Thus, in the present invention, the liquid holding portion is positioned so as to satisfy the above relationship.

DETAILED DESCRIPTION OF THE INVENTION

The liquid holding portion may be formed by bonding other bodies, or by protruding or recessing a part of the inner surface of the light emitting portion. In other words, the liquid holding portion may be formed as a projection (valve projection that protrudes toward the center of the lamp) or a groove on the inner surface of the light emitting portion. When forming a groove as the liquid holding portion, it is preferable that the depth t of the groove satisfies $0.2T \leqq t \leqq 0.5T$, where T is a thickness of the translucent ceramic at the light emitting portion. When the depth t is too large, cracks may appear at the liquid holding portion and decrease a resistance to pressure of the light emitting bulb. When the depth t is too small, the capacity of holding liquefied iodide is decreased. The liquid holding portion can extend around the entire circumference of the light emitting portion.

It is preferable that the liquid holding portion is spaced from the boundary (connecting portion) between the light emitting portion and the tubular portion, that is, the liquid holding portion should be formed at a distance from the tubular portion. If the liquid holding portion is positioned on the boundary, the liquefied iodide accelerates the corrosion of the ceramics.

The liquid holding portion may be formed on a diameter lessening portion of the light emitting portion between the maximum diameter portion and the tubular portion.

Figure 1:
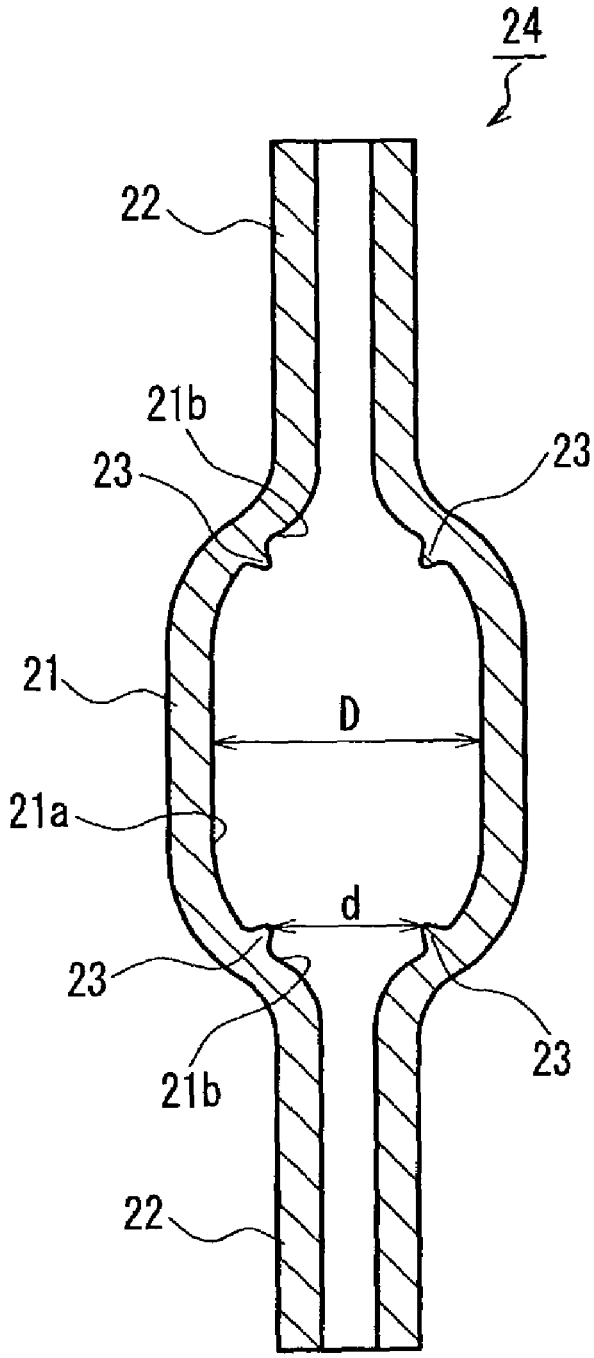
FIG. 1 is a cross-sectional view showing an example of the light emitting bulb for the metal halide lamp of the present invention.

In the light emitting bulb 24 of FIG. 1, the projections 23 are formed on the inner surface of the light emitting portion 21. The maximum internal diameter portion 21*a* of the light emitting portion 21 gradually becomes narrow in both ends to form diameter lessening portions (tapered portions) 21*b*, which are connected to the tubular portions 22. The projections 23 are formed on the diameter lessening portions 21*b*, and reduce the internal diameter d to more than 0.4D and less than 0.7D, where D is an internal diameter at the maximum internal diameter portion 21*a*.

Figure 2:
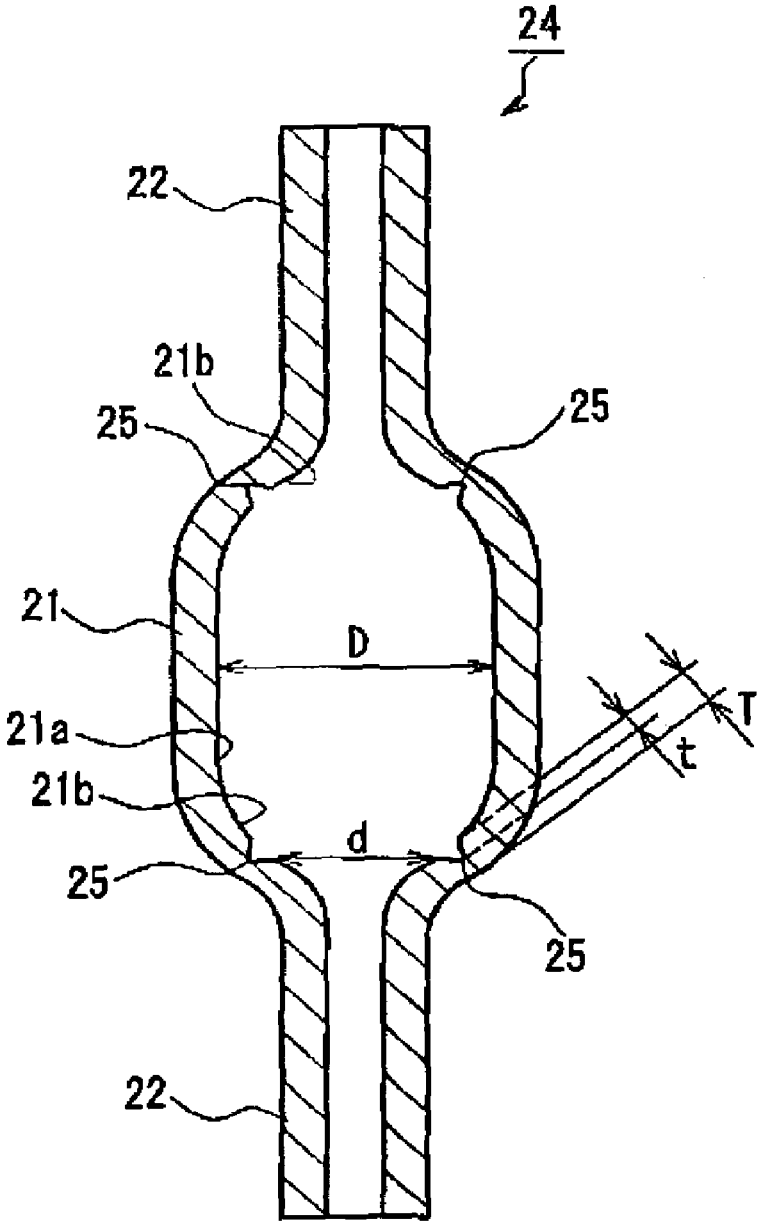
FIG. 2 is a cross-sectional view showing another example of the light emitting bulb for the metal halide lamp of the present invention.

The liquid holding portions may be formed by partially recessing the internal surface of the light emitting bulb 24, instead of partially protruding the internal surface. As shown in FIG. 2, the liquid holding portions may be grooves 25 in the diameter lessening portions 21*b*. The grooves 25 should be formed so as to have a depth of 0.2T to 0.5T, where T is a thickness of the light emitting portion 21. Each of the projections 23 and the grooves 25 may form a ring on the inner surface of the light emitting portion 21*a* at a predetermined height of the light emitting bulb 24 that stands vertically.

In this specification, the internal diameter d is determined based on the top of the projection 23 (FIG. 1) or the inner edge of the groove 25 (FIG. 2).

Hereinafter, an example of method for manufacturing a light emitting bulb that includes a liquid holding portion will be described.

Figure 3:
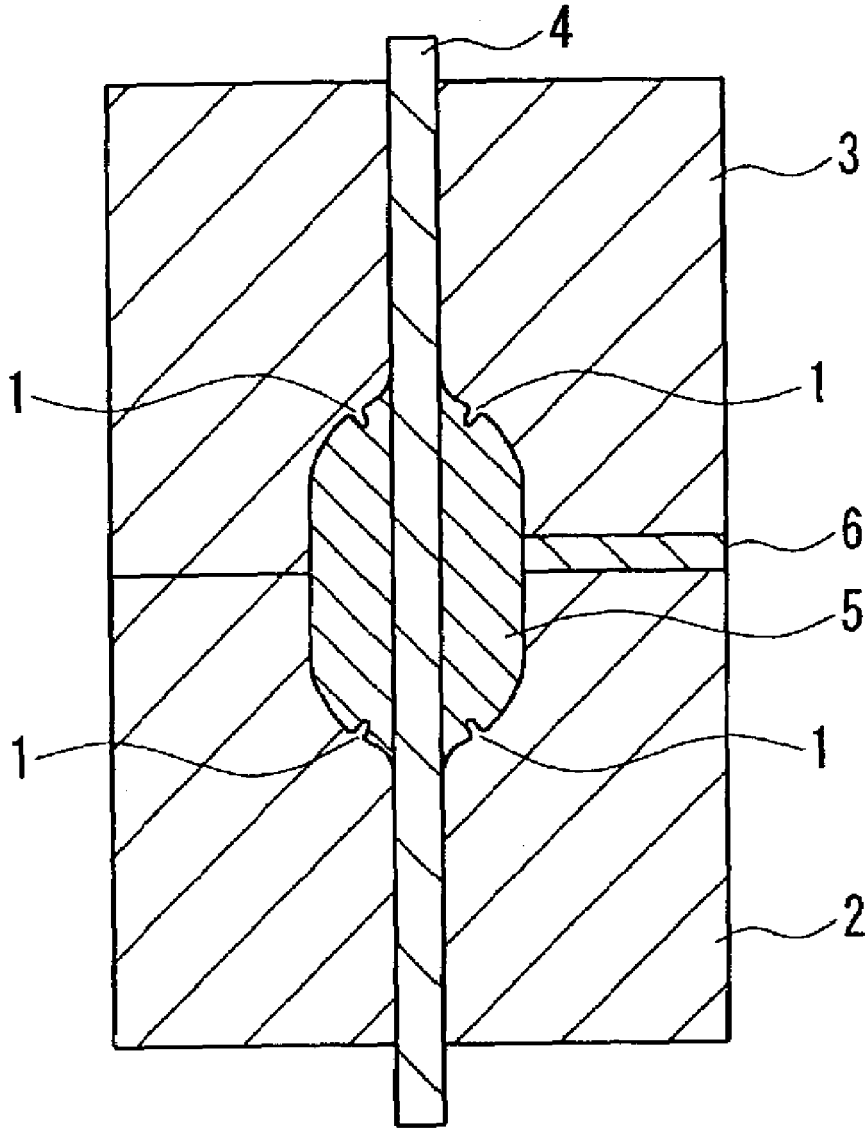
FIG. 3 is a cross-sectional view showing a step of pouring wax into a core mold that is used for manufacturing a light emitting bulb.
Figure 4:
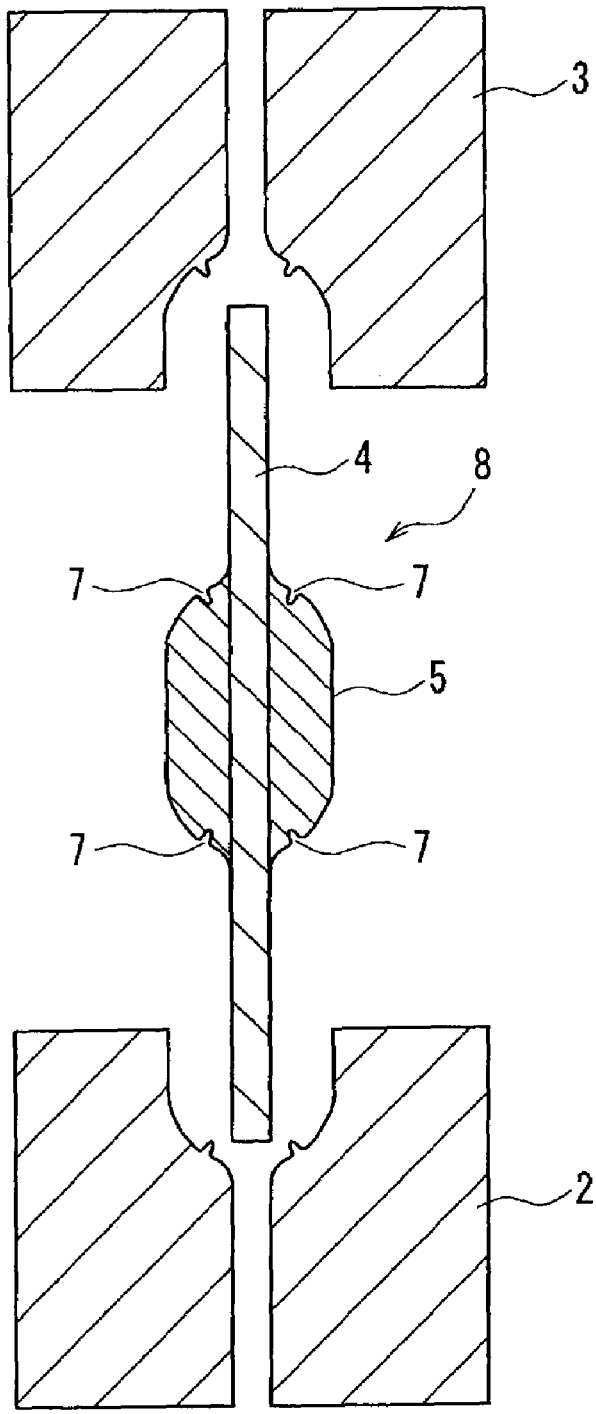
FIG. 4 is a cross-sectional view showing a step of taking out a core from the mold of FIG. 3.

First, a core is prepared. As shown in FIG. 3, stainless steel core molds 2 and 3 that have convex portions 1 are designed, taking into consideration a shrinkage rate during sintering of a ceramic. A stainless steel core wire 4 is arranged in the molds 2 and 3 as an axis of the core. Paraffin-based wax that has a melting point of 70° C. is poured into the molds through an opening 6 of the molds 2 and 3, after the wax is melted, for example, at 90° C. The molds 2 and 3 with the wax are left and cooled to around room temperature to harden the wax 5. As shown in FIG. 4, the core 8 is taken out from the divided molds 2 and 3. The core 8 includes concave portions 7 that are derived from the convex portions 1 of the molds 2 and 3.

Figure 5:
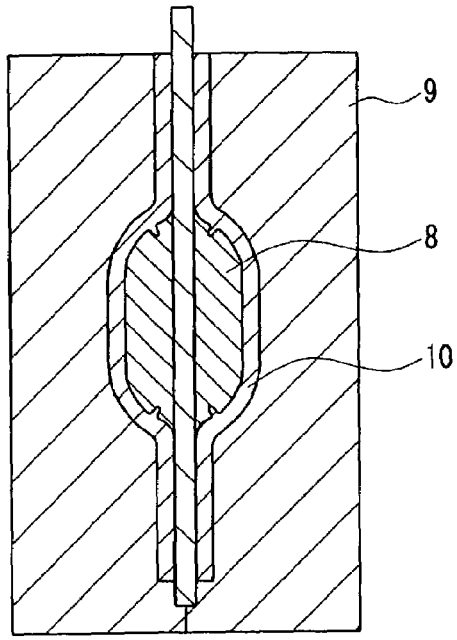
FIG. 5 is a cross-sectional view showing a step of pouring slurry into a gap between a bulb mold and the core obtained by a step of FIG. 4.

Second, a slurry is shaped with the core and a mold in FIG. 5. A bulb mold 9 for forming a light emitting bulb also is designed, taking into consideration a shrinkage rate during sintering of a ceramic. The core 8 is arranged in the mold 9. Slurry 10 is poured into a gap between the core 8 and the mold 9, which is left to cool at room temperature, for example, for a day and harden the slurry 10.

The slurry 10 can be prepared, for example, by the following method. A material solution that includes 100 weight parts of alumina, 0.05 weight part of magnesium oxide as an additive, 1.0 weight part of polycarboxylate as a dispersing agent, 10 weight parts of water-soluble epoxy resin as a hardening agent, and 25 weight parts of water as a solvent is mixed in a pot. Then, 2 weight parts of an amine-based hardening agent for allowing it to react with the water-soluble epoxy resin are added to the material solution, followed by mixing them in the pot.

Figure 6:
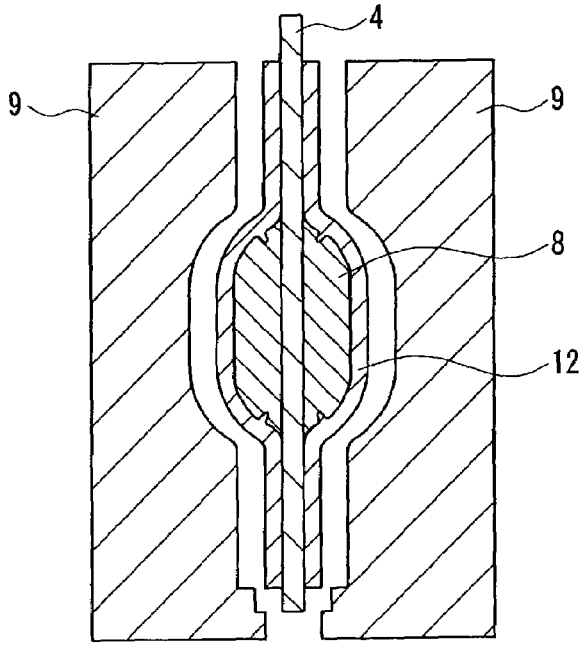
FIG. 6 is a cross-sectional view showing a step of taking out a slurry hardened body from the mold of FIG. 5.

As shown in FIG. 6, the hardened slurry 12 is taken out from the divided mold 9, and the core wire 4 is pulled out from the hardened slurry 12. The hardened slurry 12 is set vertically in a thermostat, for example, at 90° C. to let the wax 5 be melted and flow away.

Figure 7:
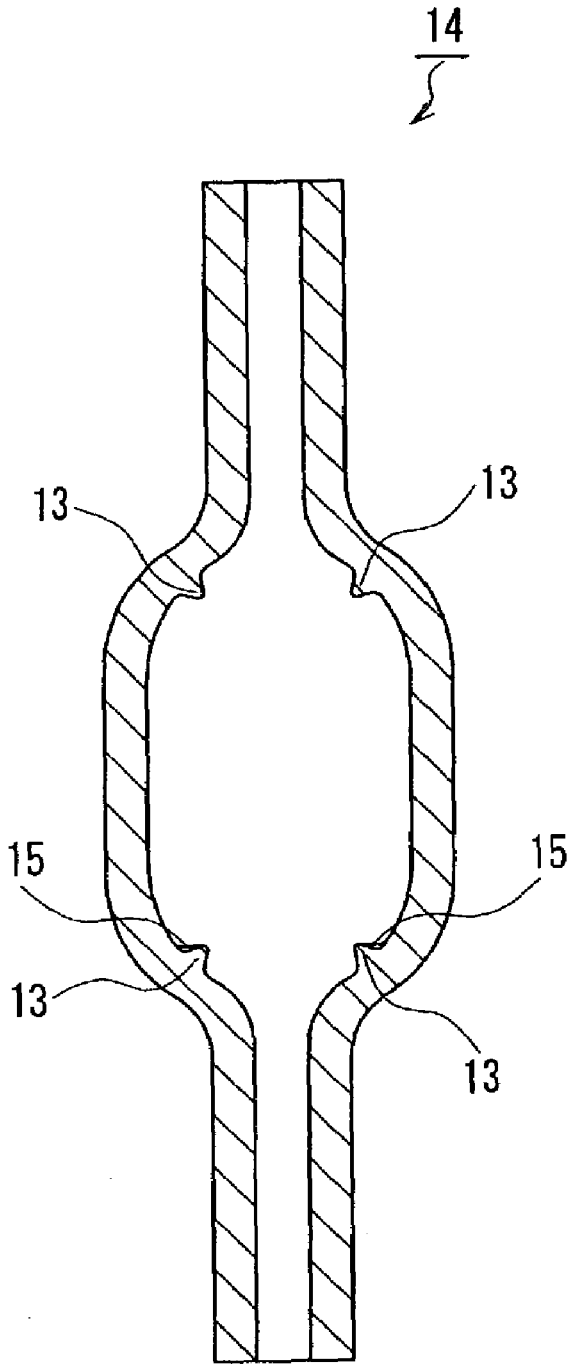
FIG. 7 is a cross-sectional view showing a step of letting the wax drain out by heating the slurry hardened body obtained by a step of FIG. 6.

As shown in FIG. 7, a part of wax 15 may remain on the liquid holding portion 13 in the hardened slurry. The wax 15 can be burned away in a debinder process. This treatment can be conducted by heating the hardened slurry, for example, at 400° C. for 2 hours in air to decompose the organic composition. Provisional firing, for example, at 1300° C. for 5 hours and firing in a reducing atmosphere such as in hydrogen, for example, at 1900° C. for 2 hours after the debinder treatment can turn the hardened slurry to a light emitting bulb 14 of translucent ceramic.

Figure 8:
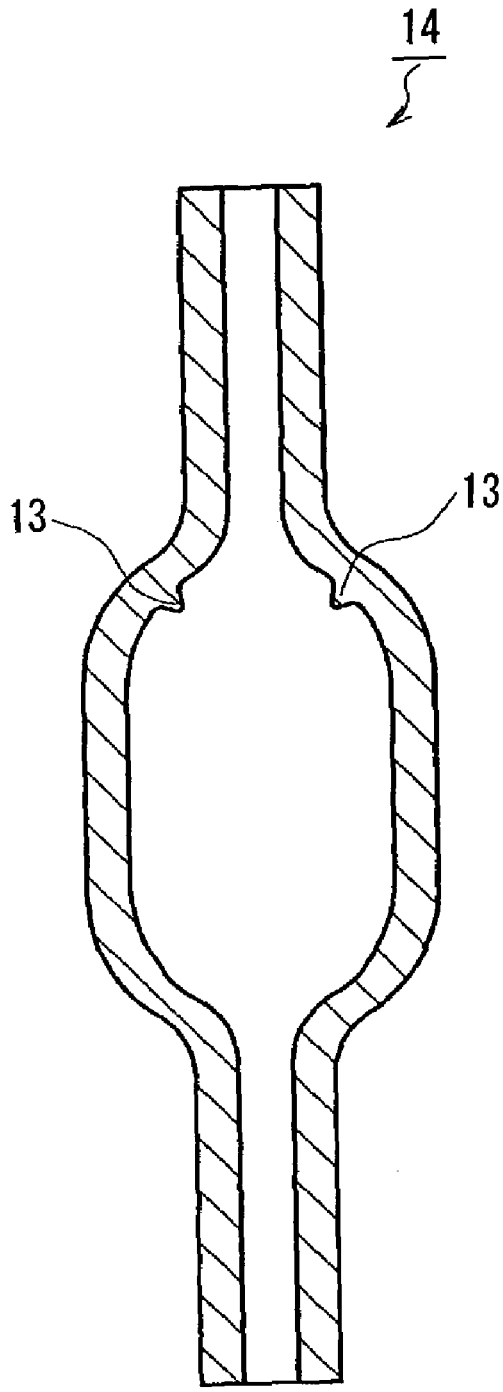
FIG. 8 is a cross-sectional view showing still another example of the light emitting bulb for the metal halide lamp of the present invention.

To simplify the above process, a liquid holding portion 13 should be formed on one of the two diameter lessening portions as shown in FIG. 8. Since the diameter lessening portion that has the liquid holding portion 13 is positioned on an upper side, all the wax can flow away. This light emitting bulb 14 should be used after turning upside down so that the liquid holding portion 13 may be positioned on a lower side.

In the above method, paraffin-based wax is used for forming the core. Instead of the wax, a resin removable by heating, preferably a resin that is melted and flows by heating (a thermomelt resin, or a thermoflow resin), more preferably a resin that can be decomposed at a higher temperature, may be used. Examples of the resin include an ethylene-vinyl acetate copolymer resin that is melted at around 100° C. Other thermoplastic resins such as polyethylene-based resin also can be used. The composition of the slurry is not limited to the above composition. For example, instead of epoxy resin, phenol-based resin, urea-based resin, and urethane-based resin can be used as a hardening agent.

Figure 9:
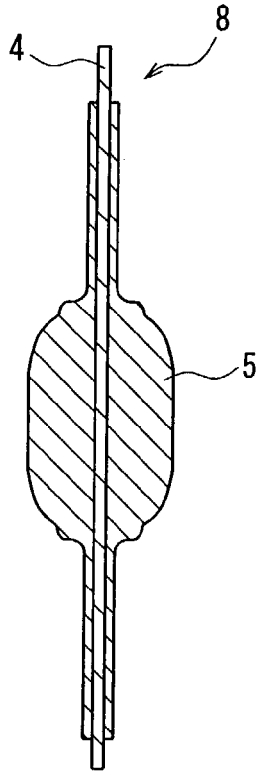
FIG. 9 is a cross-sectional view showing another core for manufacturing a light emitting bulb.
Figure 10:
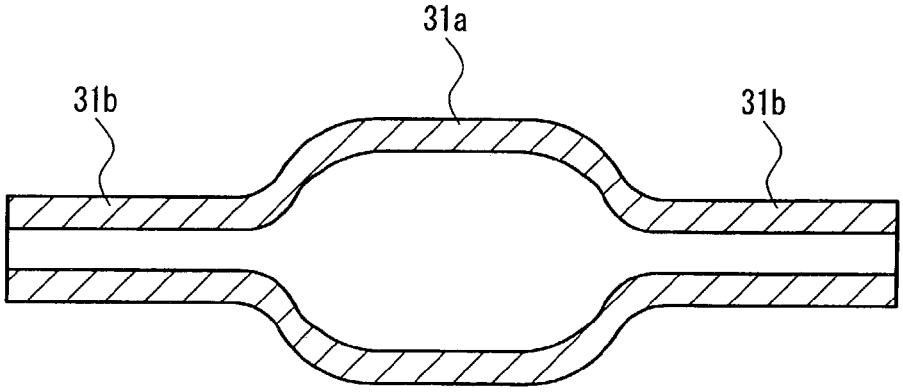
FIG. 10 PRIOR ART
FIG. 10 is a cross-sectional view showing a conventional light emitting bulb.
Figure 11:
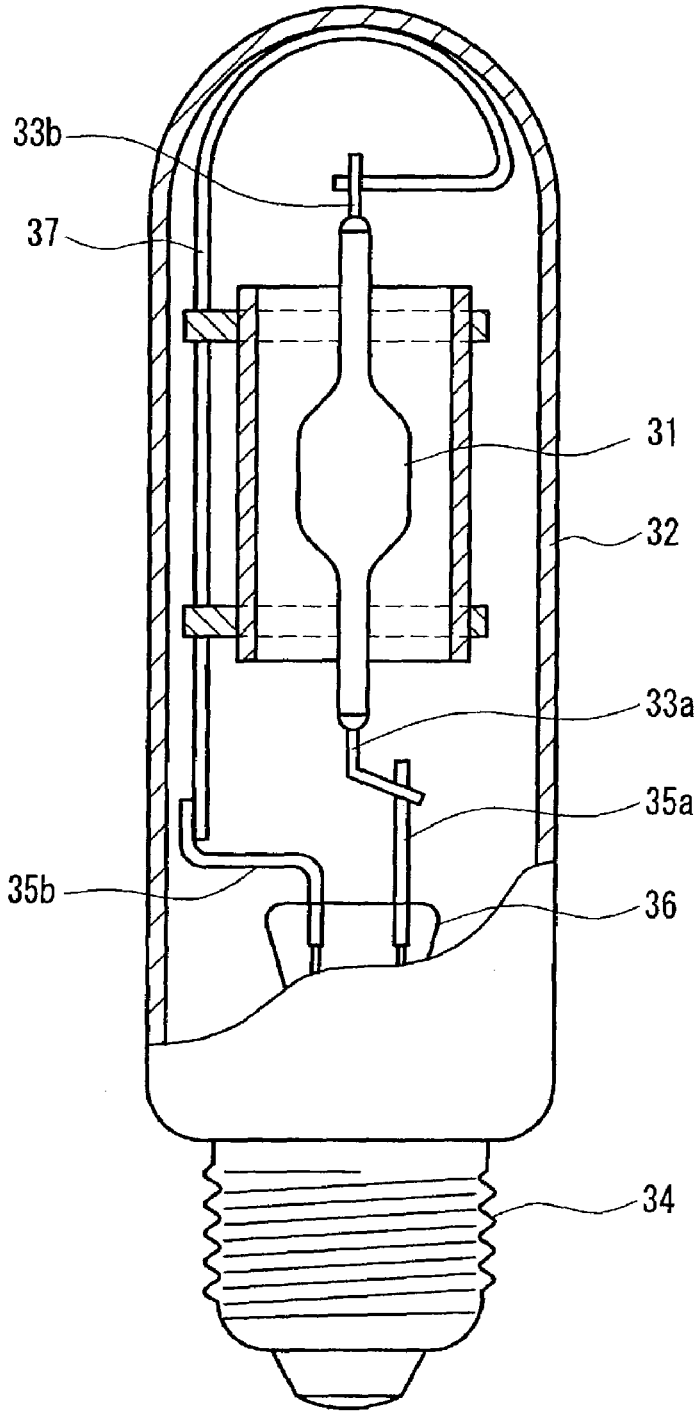
FIG. 11 PRIOR ART
FIG. 11 is a cross-sectional view showing a conventional metal halide lamp.
Figure 12:
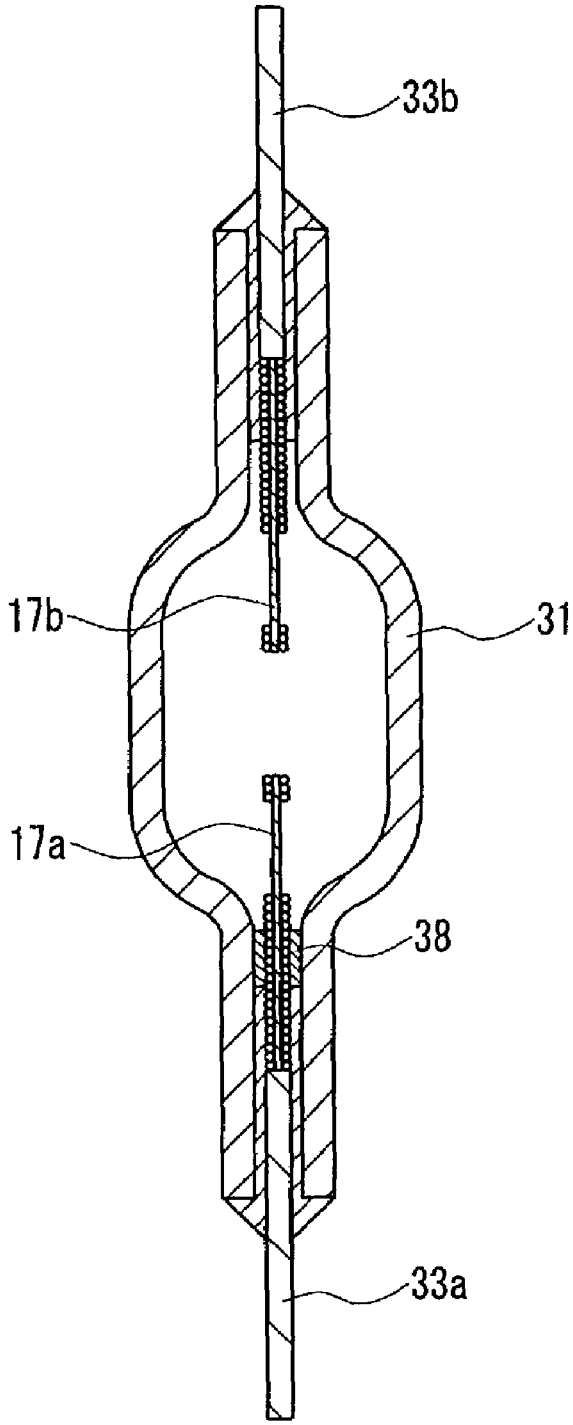
FIG. 12 PRIOR ART
FIG. 12 is a cross-sectional view showing the light emitting bulb in the lamp of FIG. 11.

A light emitting bulb that includes a recess as a liquid holding portion also can be formed by the above method. In this case, as shown in FIG. 9, a core 9 that includes convex portions should be used.

A light emitting bulb of the present invention can be manufactured by a method that includes: i) pouring slurry that includes at least ceramic powder and a hardening agent into a gap between a core and a mold, wherein the core includes a resin body that has a predetermined projection or groove, ii) hardening the slurry so as to form a hardened slurry, and iii) melting the resin body by heating so as to flow at least a part of the resin body away. The method further may include iv) thermally-decomposing the remaining resin body on the groove or projection (liquid holding portion) of the hardened slurry that is derived from the projection or groove of the resin body. The core further may include a core wire. In this case, the above method further may include: a step of pulling out the core wire to ensure a route for flow of the melted resin body after hardening the slurry. It is difficult to obtain a light emitting bulb that has a liquid holding portion by a conventional method such as a casting method in which dehydrated slurry is piled on the inner surface of a plaster mold that absorbs water. On the other hand, by the above method, it is possible to produce a light emitting bulb that has a liquid holding portion in quantity.

In the metal halide lamp of the present invention, conventional materials can be used for each component except the light emitting bulb, and the material to be sealed in the bulb is not limited. However, when at least one selected from the cerium (Ce) and praseodymium (Pr) is sealed in the light emitting bulb, which are high efficiency light emitting substances, the load to the bulb should be kept at a high level to ensure a sufficient vapor pressure of these substances. This is because these metals have low vapor pressures. In this case, the light emitting bulb should have a liquid holding portion in a position where cracks hardly appear in the bulb to ensure a sufficient pressure resistance.

Metal halide lamps were prepared with light emitting bulbs as shown in FIG. 1 that were obtained by the above method. The light emitting bulbs included projections 23 as liquid holding portions. The maximum internal diameter D was 17.2 mm. The positions of the liquid holding portions were determined to set the diameter d at a value disclosed in Table 1. Ten lamps per each type of the lamps were prepared. Changes in color temperature of the lamps over 3,000 hours lighting were measured, and the presence or absence of cracks was observed. The results are shown in Table 1.

TABLE 1

| d (mm) | 6.5 | 7.0 | 9.5 | 12.0 | 12.5 |
|---|---|---|---|---|---|
| d/D | 0.378 | 0.407 | 0.552 | 0.698 | 0.727 |
| Change in Color Temperature (K.) | 185 | 200 | 245 | 280 | 450 |
| Rate of Causing Cracks | 2/10 | 0/10 | 0/10 | 0/10 | 0/10 |

When d/D is not more than 0.4, the liquid holding portions are too close to the electrode, which causes cracks. When d/D is not less than 0.7, the liquid holding portions cannot sufficiently suppress the change of the color temperature. The range of d/D is preferably more than 0.4 and less than 0.7.

Metal halide lamps were prepared with light emitting bulbs as shown in FIG. 2 that were obtained by the above method. The light emitting bulbs included grooves 25 as liquid holding portions. The maximum internal diameter D was 17.2 mm. The positions of the liquid holding portions were determined to set the diameter d at a value disclosed in Table 2. The grooves have a depth t of 0.35 mm and the light emitting bulbs have a thickness T of 1.0 mm. Ten lamps per each type of the lamps were prepared. Changes in color temperature of the lamps in 3,000 hours lighting were measured, and the presence or absence of cracks was observed. The results are shown in Table 2.

TABLE 2

| d (mm) | 6.5 | 7.0 | 9.5 | 12.0 | 12.5 |
|---|---|---|---|---|---|
| d/D | 0.378 | 0.407 | 0.552 | 0.698 | 0.727 |
| Change in Color Temperature (K.) | 185 | 210 | 235 | 290 | 420 |
| Rate of Causing Cracks | 1/10 | 0/10 | 0/10 | 0/10 | 0/10 |

Table 2 also shows that the range of $0.4<d/D<0.7$ is preferred.

Further, metal halide lamps were prepared with light emitting bulbs that had grooves as liquid holding portions. The grooves are formed to set a diameter d at 10 mm (d/D at 0.581) and a depth t at a value shown in Table 3. The thickness T of the light emitting bulb is 1.0 mm. Ten lamps per each type of the lamps were prepared. Changes in color temperature of the lamps over 3,000 hours lighting were measured, and the presence or absence of cracks was observed. The results are shown in Table 3.

TABLE 3

| T (mm) | 0.1 | 0.2 | 0.35 | 0.5 | 0.6 |
|---|---|---|---|---|---|
| t/T | 0.1 | 0.2 | 0.35 | 0.5 | 0.6 |
| Change in Color Temperature (K.) | 350 | 275 | 245 | 220 | 190 |
| Rate of Causing Cracks | 0/10 | 0/10 | 0/10 | 0/10 | 1/10 |

Table 3 shows that the range of $0.2 \leqq t/T \leqq 0.5$ is preferred since the grooves in the range suppress cracks and the change in color temperature. As described above, the present invention can provide a metal halide lamp in which the change of the color temperature is suppressed, regardless of the orientation of the lamp axis in use.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A metal halide lamp comprising a light emitting bulb of translucent ceramic that comprises a light emitting portion and tubular portions, the tubular portions being connected to a pair of ends of the light emitting portion, wherein the light emitting portion and the tubular portions are integrally formed in a mold, wherein the light emitting portion comprises a liquid holding portion on an inner surface of the light emitting portion so as to hold a liquefied substance that moves on the inner surface toward one of the tubular portions, wherein the liquid holding portion is formed on a tapered portion of the light emitting portion at a position between a maximum diameter portion and the tubular portion, and the liquid holding portion is formed of a projection or a groove to form a ring on the inner surface of the light emitting portion, and wherein the internal diameter d of the light emitting bulb at the liquid holding portion satisfies $0.4D<d<0.7D$, where D is an internal diameter of the light emitting bulb at the maximum internal diameter portion of the light emitting portion, wherein the liquid holding portion is spaced longitudinally from a nearest of the tubular portions, and wherein the tapered portion of the light emitting portion narrows in diameter to form a cone shape.

2. The metal halide lamp according to claim 1, wherein the liquid holding portion is formed by recessing a part of the inner surface of the light emitting portion, and the depth t of the liquid holding portion satisfies $0.2T \leqq t \leqq 0.5T$, where T is a thickness of the translucent ceramics at the light emitting portion.

3. The metal halide lamp according to claim 1, wherein the liquid holding portion is spaced from the boundaries of the light emitting portion and the tubular portions.

4. The metal halide lamp according to claim 1, wherein the light emitting portion has a diameter lessening portion between the maximum diameter portion and the tubular portion, and wherein the liquid holding portion is formed on the diameter lessening portion.

5. The metal halide lamp according to claim 1, wherein at least one of cerium and praseodymium is sealed in the metal halide lamp.

6. A metal halide lamp comprising a light emitting bulb of translucent ceramic that comprises a light emitting portion and tubular portions, the tubular portions being connected to a pair of ends of the light emitting portion, wherein the light emitting portion and the tubular portions are integrally formed in a mold, wherein the light emitting portion comprises a liquid holding portion on an inner surface of the light emitting portion so as to hold a liquefied substance that moves on the inner surface toward one of the tubular portions, wherein the liquid holding portion is formed on a tapered portion of the light emitting portion at a portion between a maximum diameter portion and the tubular portion, wherein the internal diameter d of the light emitting bulb at the liquid holding portion satisfies $0.4D<d<0.7D$, where D is an internal diameter of the light emitting bulb at the maximum internal diameter portion of the light emitting portion, wherein the liquid holding portion is spaced longitudinally from a nearest of the tubular portions, and wherein the tapered portion of the light emitting portion narrows in diameter to form a cone shape, the light emitting bulb being produced by:

(i) pouring slurry, that includes at least ceramic powder and a hardening agent, into a gap between a core and a mold, wherein the core includes a resin body that has a predetermined projection or groove;

(ii) hardening the slurry so as to form a hardened slurry;

(iii) heating the resin body, so at least a part of the resin body melts and flows away;

(iv) burning away any resin body still left on the hardened slurry; and (v) final firing.

7. The metal halide lamp according to claim 6, wherein the liquid holding portion is formed by protruding or recessing a part of the inner surface of the light emitting portion.

8. The metal halide lamp according to claim 7, wherein the liquid holding portion is formed by recessing a part of the inner surface of the light emitting portion, and the depth t of the liquid holding portion satisfies $0.2T \leqq t \leqq 0.5T$, where T is a thickness of the translucent ceramics at the light emitting portion.

9. The metal halide lamp according to claim 6, wherein the liquid holding portion is spaced from the boundaries of the light emitting portion and the tubular portions.

10. The metal halide lamp according to claim 6, wherein the light emitting portion has a diameter lessening portion between the maximum diameter portion and the tubular portion, and wherein the liquid holding portion is formed on the diameter lessening portion.

11. The metal halide lamp according to claim 6, wherein at least one of cerium and praseodymium is sealed in the metal halide lamp.

* * * * *

UNITED STATES PATENT AND TRADEMARK OFFICE

CERTIFICATE OF CORRECTION

PATENT NO. : 7,227,309 B2
APPLICATION NO. : 10/392577
DATED : June 5, 2007
INVENTOR(S) : Horibe et al.

It is certified that error appears in the above-identified patent and that said Letters Patent is hereby corrected as shown below:

Col. 8, line 22, add claim 12, to read as follows:
--12. The metal halide lamp according to claim 7, wherein the production process further comprises:
provisional firing of the hardened slurry prior to final firing.--

Signed and Sealed this

Twelfth Day of August, 2008

JON W. DUDAS
*Director of the United States Patent and Trademark Office*